US012018892B2

(12) United States Patent
Chen et al.

(10) Patent No.: US 12,018,892 B2
(45) Date of Patent: Jun. 25, 2024

(54) SYSTEMS AND METHODS FOR THERMAL MANAGEMENT USING SEPARABLE HEAT PIPES AND METHODS OF MANUFACTURE THEREOF

(71) Applicant: California Institute of Technology, Pasadena, CA (US)

(72) Inventors: Weibo Chen, Pasadena, CA (US); Benjamin I. Furst, Pasadena, CA (US); Scott N. Roberts, Altadena, CA (US)

(73) Assignee: California Institute of Technology, Pasadena, CA (US)

( * ) Notice: Subject to any disclaimer, the term of this patent is extended or adjusted under 35 U.S.C. 154(b) by 276 days.

(21) Appl. No.: 17/453,332

(22) Filed: Nov. 2, 2021

(65) Prior Publication Data

US 2022/0136779 A1 May 5, 2022

Related U.S. Application Data

(60) Provisional application No. 63/108,579, filed on Nov. 2, 2020.

(51) Int. Cl.
*F28D 15/02* (2006.01)
*F28D 15/04* (2006.01)

(52) U.S. Cl.
CPC ..... *F28D 15/0241* (2013.01); *F28D 15/04* (2013.01)

(58) Field of Classification Search
CPC ..... F28F 2275/10; F28F 2255/02; F28F 2200/005; F28D 15/046; F28D 15/04; F28D 15/0275; F28D 15/0266; F28D 15/0241
See application file for complete search history.

(56) References Cited

U.S. PATENT DOCUMENTS 3,750,745 A * 8/1973 Moore, Jr. ..... F28D 15/0275 165/104.26
3,786,861 A * 1/1974 Eggers ..... F28D 15/046 165/104.26
4,602,679 A 7/1986 Edelstein et al.
5,335,720 A * 8/1994 Ogushi ..... F28D 15/04 122/366

(Continued)

OTHER PUBLICATIONS

Pumped Two Phase Cooling, Advanced Cooling Technologies, Retrieved from https://www.1-act.com/innovations/pumped-two-phase-cooling/.

(Continued)

*Primary Examiner* — Tho V Duong

(57) ABSTRACT

Systems and methods for thermal management using separable heat pipes and methods of manufacture thereof. Various embodiments provide a porous insert that can be used to join or connect heat pipes. Further embodiments provide thermal management systems that are modular, expandable, reparable, by allowing for joining of evaporators, condensers, and adiabatic sections via porous inserts. Various embodiments allow for two-phase thermal management systems, where liquid and gaseous phases can be transported simultaneously. Certain embodiments incorporate heat generating components with embedded evaporators and/or condensers. Many embodiments are additively manufactured, including via 3D printing.

12 Claims, 5 Drawing Sheets
(4 of 5 Drawing Sheet(s) Filed in Color)

500

(56) References Cited

U.S. PATENT DOCUMENTS

| | | | | |
|---|---|---|---|---|
| 5,632,158 | A * | 5/1997 | Tajima | F28D 15/046 165/104.33 |
| 5,647,429 | A * | 7/1997 | Oktay | H05K 7/20809 165/104.33 |
| RE35,721 | E | 2/1998 | Daikoku et al. | |
| 5,725,049 | A | 3/1998 | Swanson et al. | |
| 5,771,967 | A * | 6/1998 | Hyman | B64G 1/50 126/45 |
| 6,330,907 | B1 | 12/2001 | Ogushi et al. | |
| 6,382,309 | B1 | 5/2002 | Kroliczek et al. | |
| 6,675,887 | B2 * | 1/2004 | Garner | F28D 15/06 165/274 |
| 6,738,257 | B1 * | 5/2004 | Lai | F28F 1/32 174/15.2 |
| 7,775,261 | B2 | 8/2010 | Valenzuela | |
| 8,505,497 | B2 | 8/2013 | Lundgreen | |
| 8,596,338 | B2 | 12/2013 | Chen et al. | |
| 9,179,575 | B1 | 11/2015 | Yao | |
| 9,282,678 | B2 | 3/2016 | Campbell et al. | |
| 10,746,475 | B2 | 8/2020 | Roberts et al. | |
| 11,114,713 | B2 | 9/2021 | Sunada et al. | |
| 2003/0141045 | A1 * | 7/2003 | Oh | F28D 15/046 165/104.26 |
| 2003/0205364 | A1 | 11/2003 | Sauciuc et al. | |
| 2008/0283223 | A1 | 11/2008 | Chang et al. | |
| 2009/0059528 | A1 | 3/2009 | Damsohn et al. | |
| 2009/0313828 | A1 | 12/2009 | Kim et al. | |
| 2010/0209759 | A1 | 8/2010 | Rejman et al. | |
| 2011/0287285 | A1 | 11/2011 | Yoon | |
| 2012/0137718 | A1 | 6/2012 | Uchida et al. | |
| 2012/0148889 | A1 | 6/2012 | Fuhr et al. | |
| 2013/0223010 | A1 | 8/2013 | Shioga et al. | |
| 2013/0312939 | A1 | 11/2013 | Uchida et al. | |
| 2014/0045024 | A1 | 2/2014 | Waters | |
| 2014/0318167 | A1 | 10/2014 | Uchida | |
| 2016/0332506 | A1 | 11/2016 | Rubitschek et al. | |
| 2017/0028869 | A1 | 2/2017 | Boddakayala et al. | |
| 2017/0047624 | A1 | 2/2017 | Gunna et al. | |
| 2017/0235349 | A1 * | 8/2017 | Ghioni | F28D 15/0275 361/679.47 |
| 2017/0346144 | A1 | 11/2017 | Addanki et al. | |
| 2018/0031330 | A1 | 2/2018 | Roberts et al. | |
| 2018/0062228 | A1 | 3/2018 | Wuensche et al. | |
| 2018/0164040 | A1 | 6/2018 | Kusano et al. | |
| 2018/0254536 | A1 | 9/2018 | Chidester et al. | |
| 2019/0140228 | A1 | 5/2019 | Handley et al. | |
| 2019/0393576 | A1 | 12/2019 | Sunada et al. | |
| 2020/0378687 | A1 | 12/2020 | Roberts et al. | |

OTHER PUBLICATIONS

"The next generation large additive machine", GE Additive, Nov. 15, 2017, Retrieved from the Internet https://www.ge.com/additive/additive-manufacturing/machines/project-atlas, 7 pgs.

"Two-Phase Evaporative Precision Cooling Systems for heat loads from 3 to 300kW", Parker Hannifin Corporation, 2011, 8 pgs.

Ambrose et al., "A pumped heat pipe cold plate for high-flux applications", Experimental thermal and fluid science, 1995, Received Aug. 30, 1993, vol. 10, pp. 156-162.

Ameli, "Additive Layer Manufactured Sinter-Style Aluminium/Ammonia Heat Pipes", Sep. 2013 Thesis, Faculty of Engineering and Environment, Research undertaken in the Faculty of Engineering and Environment in collaboration with Thermacore Europe, 182 pages.

Ameli et al., "A novel method for manufacturing sintered aluminium heat pipes (SAHP)", Applied Thermal Engineering, Jan. 5, 2013, vol. 52, pp. 498-504.

Bland et al., "A two-phase thermal management system for large space platforms", AIAA 19th Thermophysics Conference, Jun. 25-28, 1984, AIA-84-1758, 10 pgs.

Choi et al., "Experimental investigation on sintered porous wicks for miniature loop heat pipe applications", Experimental Thermal and Fluid Science, Aug. 11, 2013, vol. 51, pp. 271-278.

Coso et al., "Enhanced Heat Transfer in Biporous Wicks in the Thin Liquid Film Evaporation and Boiling Regimes", Journal of Heat Transfer, Oct. 2012, vol. 134, 11 pgs.

Crepinsek et al., "Effect of operational conditions on cooling performance of pump-assisted and capillary-driven two-phase loop", Journal of Thermophysics and Heat Transfer, Oct.-Dec. 2011, vol. 25, No. 4, pp. 572-580.

Delil et al., "Development of a Mechanically Pumped Two-Phase CO2 Cooling Loop for the AMS-2 Tracker Experiment", National Aerospace Laboratory NLR, SAE Technical Paper, No. 2002-01-2465, Jul. 14-18, 2002, 11 pgs.

Drolen et al., "Lithium Ion Battery Thermal Propagation Modeling: Considerations and Lessons Learned", 2017, Retrieved from the Internet https://nescacademy.nasa.gov/video/f9c8eb57f8114f47b279877b703214cc1d, 14 pgs.

Frazier et al., "Metal additive manufacturing: a review", Journal of Materials Engineering and Performance, Jun. 2014, vol. 23, No. 6, pp. 1917-1928, doi: 10.1007/s11665-014-0958-z.

Friedel, "Improved friction pressure drop correlations for horizontal and vertical two phase pipe flow", 3R International, Jul. 1979, vol. 18, No. 7, pp. 485-491.

Furst et al., "A Comparison of System Architectures for a Mechanically Pumped Two-Phase Thermal Control System", 47th International Conference on Environmental Systems, Jul. 16-20, 2017, ICES-2017-119, 20 pgs.

Gou et al., "Feasibility study on a novel 3D vapor chamber used for Li-ion battery thermal management system of electric vehicle", Applied Thermal Engineering, Feb. 9, 2019, 15 pgs., doi: https://doi.org/10.1016/j.applthermaleng.2019.02.034.

Holley et al., "Permeability and effective pore radius measurements for heat pipe and fuel cell applications", Applied thermal engineering, 2006, Accepted May 22, 2005, vol. 26, pp. 448-462.

Jiang et al., "Experimental investigation of pump-assisted capillary phase change loop", Applied Thermal Engineering, Jul. 19, 2014, vol. 71, pp. 581-588.

Kim et al., "Review on Battery Thermal Management System for Electric Vehicles", Applied Thermal Engineering, Dec. 3, 2018, 84 pgs., doi: 10.1016/j.applthermaleng.2018.12.020.

Konishi et al., "Review of flow boiling and critical heat flux in microgravity", International Journal of Heat and Mass Transfer, 2015, Available online Oct. 11, 2014, vol. 80, pp. 469-493.

Kozuki et al., "Skeletal Structure with Artificial Perspiration for Cooling by Latent Heat for Musculoskeletal Humanoid Kengoro", IEEE/RSJ International Conference on Intelligent Robots and Systems (IROS), Oct. 9-14, 2016, pp. 2135-2140, doi: 10.1109/IROS.2016.7759335.

Krishna et al., "Low stiffness porous Ti structures for load-bearing implants", Acta Biomaterialia, May 25, 2007, vol. 3, pp. 997-1006.

Ku, "Operating characteristics of loop heat pipes", 29th International Conference on Environmental System, Jul. 12-15, 1999, 1999-01-2007, 16 pgs.

Ku et al., "The Hybrid Capillary Pumped Loop", SAE Technical Paper, No. 881083, 1988, 11 pgs.

Lemmon et al., "NIST reference fluid thermodynamic and transport properties-REFPROP", NIST standard reference database 23, Version 7.0, Aug. 2002, 162 pgs.

Liu et al., "Experimental Investigation of New Flat-Plate-Type Capillary Pumped Loop", Journal of Thermophysics and Heat Transfer, Jan.-Mar. 2008, vol. 22, No. 1, pp. 98-104.

Lockhart et al., "Proposed correlation of data for isothermal two-phase, two-component flow in pipes", Chemical Engineering Progress, 1949, vol. 45, No. 1, pp. 39-48.

Marchitto et al., "Experiments on two-phase flow distribution inside parallel channels of compact heat exchangers", International Journal of Multiphase Flow, 2008, Received Feb. 14, 2007, vol. 34, pp. 128-144.

Nguyen et al., "Study on heat transfer performance for loop heat pipe with circular flat evaporator", International Journal of Heat and Mass Transfer, 2012, Received Dec. 26, 2010, vol. 55, pp. 1304-1315.

(56) References Cited

OTHER PUBLICATIONS

Parhizi et al., "Analytical Modeling and Optimization of Phase Change Thermal Management of a Li-ion Battery Pack", Applied Thermal Engineering, Nov. 5, 2018, 41 pgs. doi: 10.1016/j.applthermaleng.2018.11.017.
Park et al., "Performance Evaluation of a Pump-Assisted, Capillary Two-Phase Cooling Loop", Journal of Thermal Science and Engineering Applications, Jun. 2009, vol. 1, 022004, 8 pgs, doi: 10.1115/1.4000405.
Reay et al., "Cooling of electronic components", Heat Pipes: Theory, Design and Applications, 6th Edition, 2014, Chapter 8, pp. 207-225.
Reay et al., "Historical development", Heat Pipes: Theory, Design and Applications, 6th Edition, 2014, Chapter 1, pp. 1-13.
Reay et al., "Special types of heat pipe", Heat Pipes: Theory, Design and Applications, 6th Edition, 2014, Chapter 6, pp. 135-173.
Reilly et al., "Utilization of Pore-Size Distributions to Predict Thermophysical Properties and Performance of Biporous Wick Evaporators", ASME Journal of Heat Transfer, Jun. 2014, vol. 136, pp. 061501-1-061501-10.
Richard et al., "Loop Heat Pipe Wick Fabrication via Additive Manufacturing", 47th International Conference on Environmental Systems, Jul. 16-20, 2017, ICES-2017-12, 10 pgs.
Rickman et al., "Considerations for the Thermal Modeling of Lithium-Ion Cells for Battery Analysis", 46th International Conference on Environmental Systems, Jul. 10-14, 2016, Vienna, Austria, ICES-2016-009, 17 pgs.
Ruiz et al., "JRC exploratory research: Safer Li-ion batteries by preventing thermal propagation", JRC Technical Reports, Workshop report: summary & outcomes, JRC Petten, Netherlands, Mar. 8-9, 2018, 53 pgs.
Sakamoto et al., "Development of Two-Phase Mechanically Pumped Fluid Loop with Large Isothermal Evaporator using Porous Wick Structure", 47th International Conference on Environmental Systems, ICES-2017-137, Jul. 16-20, 2017, 9 pgs.
Schweickart et al., "Testing of a controller for a hybrid capillary pumped loop thermal control system", Energy Conversion Engineering Conference, Proceedings of the 24th Intersociety, IEEE 1989, pp. 69-74.
Singh et al., "Battery Cooling Architectures for Electric Vehicles Using Heat Pipes", Joint 19th IHPC and 13th IHPS, Pisa, Italy, Jun. 10-14, 2018, 10 pgs.
Sunada et al., "A Two-Phase Mechanically Pumped Fluid Loop for Thermal Control of Deep Space Science Missions", 46th International Conference on Environmental Systems, ICES-2016-129, Jul. 10-14, 2016, 20 pgs.
Tsai et al., "Flat plate loop heat pipe with a novel evaporator structure", 21st IEEE Semi-Therm Symposium, 2005, 4 pgs.
Wan et al., "Heat transfer with flow and phase change in an evaporator of miniature flat plate capillary pumped loop", Journal of Thermal Science, Apr. 2007, vol. 16, No. 3, pp. 254-263.
Wilke et al., "Preventing thermal runaway propagation in lithium ion battery packs using a phase change composite material: An experimental study", Journal of Power Sources, 2017, First Published Nov. 22, 2016, vol. 340, pp. 51-59, doi: 10.1016/j.jpowsour.2016.11.018.
Wu et al., "Experimental investigation on the thermal performance of heat pipe-assisted phase change material based battery thermal management system", Energy Conversion and Management, Feb. 21, 2017, vol. 138, pp. 486-492, doi: 10.1016/j.enconman.2017.02.022.
Yuan et al., "Inhibition effect of different interstitial materials on thermal runaway propagation in the cylindrical lithium-ion battery module", Applied Thermal Engineering, Feb. 25, 2019, vol. 153, pp. 39-502, doi: https://doi.org/10.1016/j.applthermaleng.2019.02.127.
Zhang et al, "Single-phase liquid cooled microchannel heat sink for electronic packages", Applied Thermal Engineering, Jul. 2005, vol. 25, pp. 1472-1487.

* cited by examiner

100

SYSTEMS AND METHODS FOR THERMAL MANAGEMENT USING SEPARABLE HEAT PIPES AND METHODS OF MANUFACTURE THEREOF

CROSS-REFERENCE TO RELATED APPLICATIONS

This application claims priority to U.S. Patent Application No. 63/108,579, filed Nov. 2, 2020, the disclosure of which is incorporated herein by reference in its entirety.

STATEMENT REGARDING FEDERALLY SPONSORED RESEARCH

This invention was made with government support under Grant No. 80NMO0018D0004 awarded by NASA (JPL). The government has certain rights in the invention.

FIELD OF THE INVENTION

The invention is generally directed to thermal management systems, components thereof, and methods of their manufacture; in particular, components that allow for separable and reconnectable heat pipes for use in thermal management systems.

BACKGROUND

Heat pipes are a thorough and passive way to move heat around a system. Current heat pipe systems rely on a continuous wick to transfer liquid from a condenser to an evaporator by surface tension. However, heat pipes are not reconnectable, because breaks or discontinuities in porous wicks disrupt liquid flow, thus limiting fluid transportation through a system. Thus, thermal management systems (TMSs) possessing an evaporator and a condenser cannot be disassembled, as a disconnect or separation between the evaporator and the condenser destroys the efficacy in fluid transfer within the TMS. As a result, heat-generating components require a thermal interface that is mechanically bolted to the heat pipe evaporator section to reject heat. The constraints on the locations and the footprint of these thermal interfaces can significantly limit the component layout design and thermal performance. For example, a tall electronics enclosure often requires additional heat pipes on vertical walls to transfer heat to the base where it is interfaced with a heat pipe. This restriction on heat pipe architecture also makes it difficult to separate a large spacecraft subsystem (e.g., an optical bench) or a large component (e.g., an electronics box) from the rest of the heat pipe to facilitate ground transportation and testing when adhesive is used at the thermal interface, placing significant constraints in the system validation and verification process.

Conventional fittings, such as VCR fittings and Swagelok fittings, can only connect the outer tubes, but not the capillary structure inside the tube. Therefore, a conventional heat pipe cannot have multiple mechanically separable sections. Even for a simple heat pipes, reconnecting two segments of a heat pipe does not guarantee the alignment of the porous wick to maintain the wick's overall capillary head. Thus, there exists a need for heat pipe systems that are reconnectable or modular to allow for customizable systems or to allow for repair of heat pipes, in the case of damage.

SUMMARY OF THE INVENTION

This summary is meant to provide examples and is not intended to be limiting of the scope of the invention in any way. For example, any feature included in an example of this summary is not required by the claims, unless the claims explicitly recite the feature. Also, the features described can be combined in a variety of ways. Various features and steps as described elsewhere in this disclosure can be included in the examples summarized here.

In one embodiment, an apparatus includes a body defining a longitudinal axis and defining a central bore running longitudinally with the body between opposing ends of the body, where the body is compressible, and where the body includes a capillary structure to allow for liquid transport.

In a further embodiment, the body further includes a central region to provide compressibility, where the central region provides an elastic displacement of at least 0.2 mm.

In another embodiment, the body provides at least 0.2% longitudinal strain.

In a still further embodiment, the dimensions of the body allow for at least 10% vapor flow area.

In still another embodiment, the body is additively manufactured.

In a yet further embodiment, the body is manufactured via one or more of stereolithography, fused deposition modeling, selective laser sintering, multi-jet modeling, binder-jet printing, bound metal deposition, directed energy deposition, powder bed fusion, fused filament fabrication, digital light processed, nanoparticle jetting, ultrasonic additive manufacturing, and 3D-printing.

In yet another embodiment, the body has variable porosity.

In a further embodiment again, the body is constructed of aluminum, titanium, iron nickel, cobalt, copper, magnesium, zinc, zirconium, steel, stainless steel, titanium alloys, nitinol (NiTi), and Ti-6Al-4V.

In another embodiment again, the body possess a cross-sectional shape selected from circular, oval, D-shaped, square, rectangular, and conformal.

In a further additional embodiment, a thermal management system includes an evaporator, a condenser, and an adiabatic section in fluid communication, where the evaporator is connected to the condenser via the adiabatic section, where the adiabatic section includes an outer wall and a porous medium disposed on the outer wall.

In another additional embodiment, at least one of the evaporator and the condenser is joined to the adiabatic section via a connection.

In a still yet further embodiment, the connection includes a porous insert, where the porous insert includes a body defining a longitudinal axis and defining a central bore running longitudinally with the body between opposing ends of the body, where the body is compressible, and where the body includes a capillary structure to allow for liquid transport.

In still yet another embodiment, the body further includes a central region to provide compressibility, where the central region provides an elastic displacement of at least 0.2 mm.

In a still further embodiment again, the body provides at least 0.2% longitudinal strain.

In still another embodiment again, the connection uses a fitting to hermetically or semi-hermetically seal the connection.

In a still further additional embodiment, the fitting is selected from a Swagelok fitting, a kwikflange fitting, a conflat fitting, a solderable fitting, a weldable joint, a flared fitting, a compression fitting, a ferrule fitting, an o-ring fitting, a barbed fitting, and a VCR fitting.

In still another additional embodiment, the adiabatic section is configured for two phases, where the porous medium allows for simultaneous liquid flow and vapor flow through the adiabatic section.

In a yet further embodiment again, at least one of the evaporator, the condenser, and the adiabatic section includes a different porosity within the porous medium or a dimension of the porous medium to alter liquid flow or vapor flow.

In yet another embodiment again, a thickness of the porous medium allows for at least 10% vapor flow area.

In a yet further additional embodiment, the evaporator is a plurality of evaporators or the condenser is a plurality of condensers.

In yet another additional embodiment, the plurality of evaporators are connected in parallel, in series, or in a hybrid parallel-series arrangement or the plurality of condensers are connected in parallel, in series, or in a hybrid parallel-series arrangement.

In a further additional embodiment again, the evaporator is embedded within a heat-generating component or the condenser is embedded within a heat-rejecting component.

In another additional embodiment again, the heat-generating component or the heat-rejecting component is 3D printed.

Additional embodiments and features are set forth in part in the description that follows, and in part will become apparent to those skilled in the art upon examination of the specification or may be learned by the practice of the invention. A further understanding of the nature and advantages of the present invention may be realized by reference to the remaining portions of the specification and the drawings, which forms a part of this disclosure.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The description and claims will be more fully understood with reference to the following figures and data graphs, which are presented as exemplary embodiments of the invention and should not be construed as a complete recitation of the scope of the invention.

DETAILED DESCRIPTION

Figure 1:
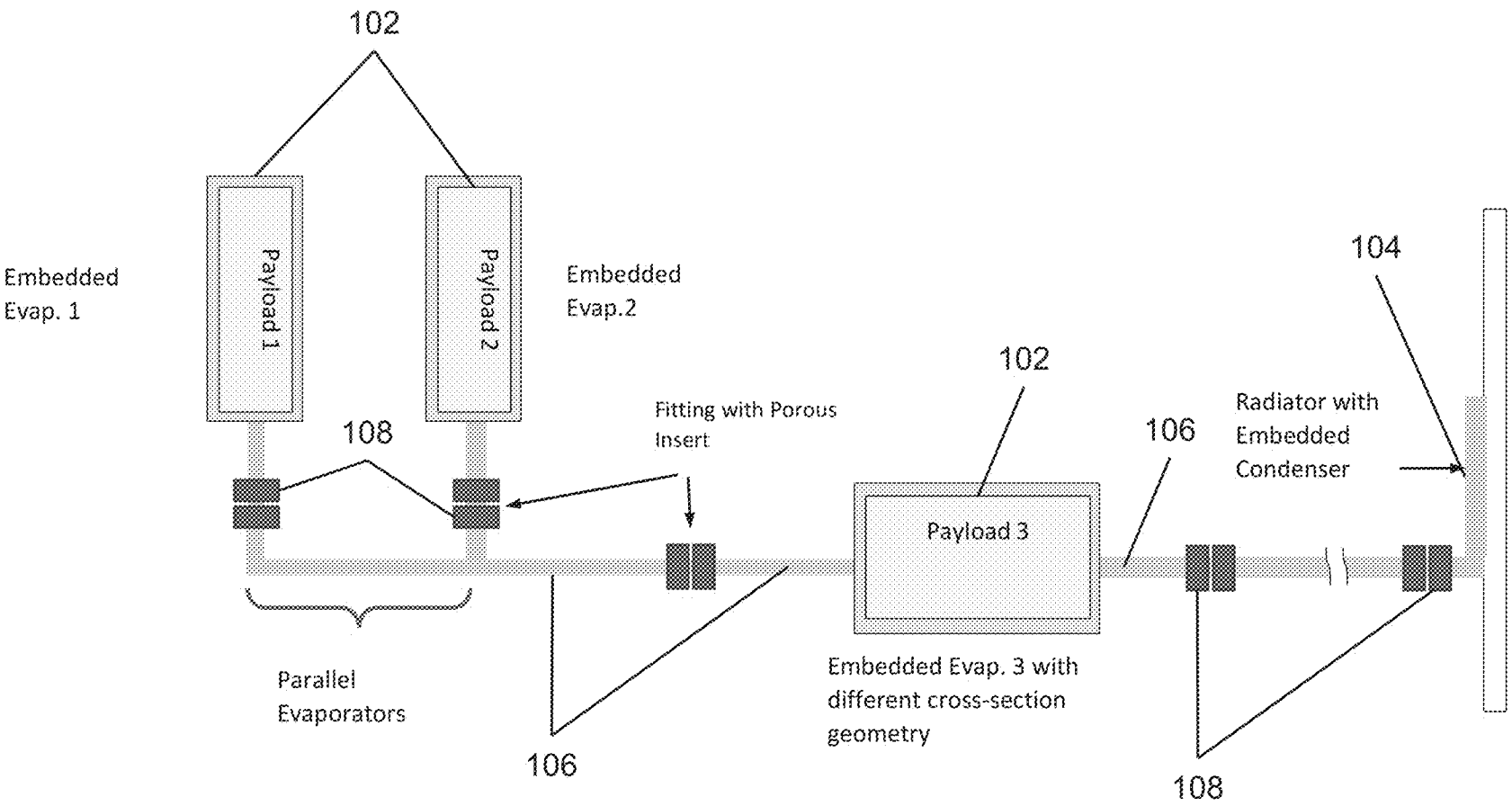
FIG. 1 provides a schematic of a thermal management system in accordance with various embodiments of the invention.

Turning now to the drawings and data, heat pipes with separable and reconnectable elements and methods of their production are provided. Heat pipes are commonly used in spacecraft and instrument Thermal Management Systems (TMSs) to acquire waste heat from heat-generating components (e.g., electronics, compressors, etc.), transport it over a long distance, and finally reject the heat in a condenser attached to a radiator. Many embodiments described herein provide performance benefits to enable broader applications of heat pipes and simplify their integration with heat-generating components and heat sinks. Further embodiments can enhance spacecraft and instrument thermal subsystem performance.

Many embodiments are also able to achieve one of the key performance benefits of a pumped loop, namely the ability to connect a complex network of heat exchangers embedded in components during the system integration stage, while eliminating the need for a mechanical pump with moving parts. Embodiments have broad applications in space and terrestrial thermal management systems, affording greater flexibility in system layout design and enhancing their performance.

Many embodiments provide a connecting element that allows for the connection of heat pipes. Many of such embodiments comprise a porous insert, which can be installed between wick segments within heat pipes. Many embodiments using a porous insert as a connecting element maintain a capillary force across porous wicks within a heat pipe, thus providing separability, reconnectability, and modularity to TMSs. Numerous embodiments minimize or eliminate pressure drop across the interface between the wick segments. Further embodiments minimize the reduction of the effective bubble point at the interface between wick segments. Various embodiments of porous inserts are additively manufactured to achieve desired properties, including size, shape, pore size, strength, displacement, and/or any other desired property for the efficacy within a TMS.

Further embodiments provide modular systems that can be expanded, repaired, and/or altered as needs change. Numerous systems in accordance with various embodiments provide suitable fluid transfer conduits, capillary pumps, filters, adiabatic sections, evaporators, condensers, etc. as will be readily configurable by those skilled in the art. Evaporators within such systems can be connected in parallel, in series, or in a hybrid parallel-series arrangement. Various embodiments allow for various sections of a system to be tailored or custom manufactured to enhance the overall performance of the system. Many embodiments allow each heat-generating component (e.g., electronic components, compressors, chemical reactors, solar panels, solar-thermal collectors, radioisotope heat units (RHUs), motors, actuators, transformers, fuses, inverters, servers, generators, engines, LEDs, displays, radios, cutting/grinding tools, batteries, sensors, lasers, lights, and/or any other device that generates heat) to use an embedded evaporator with an optimized geometry to dissipate heat, and minimizes the number of thermal interfaces from each component to the thermal bus to reduce system mass and enhance thermal performance. Embedding evaporators into components and integrating them together to form a heat pipe would eliminate the unnecessary thermal hardware and the associated thermal performance penalty.

In accordance with many embodiments, evaporators are components of a TMS that collect heat from a heat producer or payload (e.g., electronic components or any other heat producing device). Evaporators can collect heat by transforming a liquid coolant into vapor or gaseous form. Additionally, condensers in accordance with certain embodiments are used to dissipate heat from a TMS by allowing vapor or gaseous coolant to its liquid form, thus allowing a coolant to condense to its liquid form. Such release of heat can utilize heat rejecting components, such as fins, blades, and/or any other structure to dissipate heat. Adiabatic sections in accordance with many embodiments connect one or more evaporators to one or more condensers.

Many embodiments of TMSs are utilized in various industries or applications, such as electronics, transportation, and/or aerospace. For example, various embodiments can be used for thermal management of server banks/towers, personal computing devices (e.g., personal computers, laptops, notebooks, tablets, phones, etc.), and other electronic devices. Additional embodiments can be used for thermal management of batteries and/or electric motors in electric vehicles, such as cars, boats, and airplanes. In such embodiments, heat rejecting components can include body surfaces that see airflow, such as wings, a hull, or the skin of a vehicle. Further embodiments have uses in spacecraft, including satellites, where scientific equipment, solar panels, and/or any other heat-generating component can benefit from thermal management.

Turning to FIG. 1, an exemplary TMS 100 in accordance with various embodiments illustrated. In particular, FIG. 1 illustrates how one or more heat sources, or payloads 102, are attached to evaporators, where the evaporator is connected to one or more condensers 104 via adiabatic sections 106. Many embodiments include fittings 108 to connect additional payloads or condensers within the TMS 100. In many embodiments, the fittings use a porous insert described herein to join various components (e.g., payloads, evaporators, and/or condensers) to a heat pipe system.

Various embodiments allow for complex cooling surfaces to use heat pipes. Many heat generating components, such as cylindrical compressors in a cryocooler, have complex heat rejection interface geometry that might not be fully accessible once the associated subsystem is assembled. This makes it impractical to attach a preformed evaporator to the heat rejection interface at the final system integration stage. However, with many embodiments, an embedded evaporator can be built into these components and connected to the rest of the heat pipe segments during the system integration stage. Such a configuration eliminates the need for additional heat spreaders and conductors to transfer heat from the heat rejection interface to the heat pipe evaporator, reducing system mass and enhancing heat rejection performance.

Additionally, various embodiments allow for different cross-sectional geometries of components (e.g., evaporator(s), condenser(s), adiabatic section(s)) within a TMS. For example, each payload can have a specific evaporator custom tailored to, or embedded with, the payload. By having separable or modular TMSs, different geometries can be used without a need for an intermediate heat spreader. In such embodiments, an inlet and outlet port of an evaporator can be connected to a heat pipe using porous inserts and fittings, such as those described herein. In further embodiments, the components possess different capillary structure, such that some components may have larger pores or dimensions to optimize vapor and/or liquid flow through the component.

Additionally, various components can have different porous wicks within different segments or components. For example, a condenser section can use a wick with larger effective pore sizes to enhance its permeability while the evaporator section uses a wick with smaller pore sizes to enhance the overall capillary pumping pressure. Furthermore, to facilitate ground testing where gravity would negatively affect the performance of the vertical segment of a heat pipe, it is desirable to use a wick having a small pore size in these segments to enable ground testing while minimizing the negative impact on the overall wick permeability.

Figure 2A:
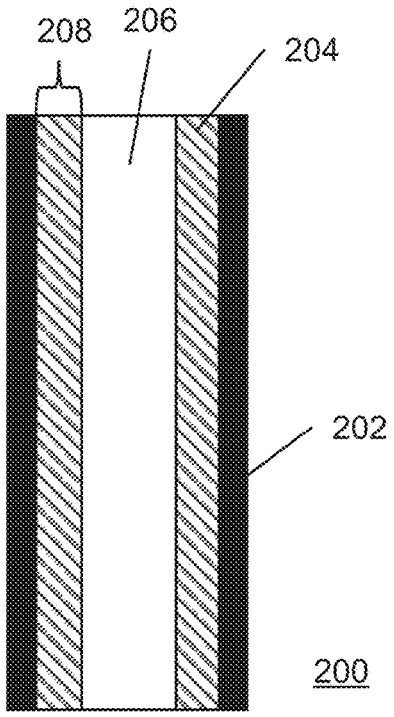
FIG. 2A provides an open view of a heat pipe in accordance with various embodiments of the invention.
Figure 2B:
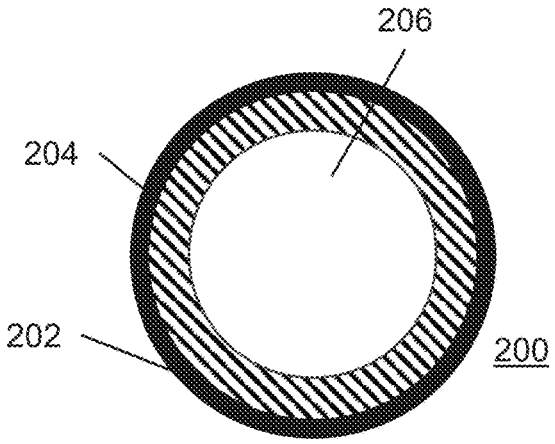
FIG. 2B provides a cross-sectional view of a heat pipe in accordance with various embodiments of the invention.

Adiabatic sections in some embodiments are configured for two-phase transfer or transport, allowing simultaneous flow of a gas (e.g., vapor) and a liquid. Turning to FIGS. 2A-2B, an open view (FIG. 2A) and a cross-sectional view (FIG. 2B) of an exemplary two-phase adiabatic section 200 is illustrated. As illustrated in FIGS. 2A-2B, adiabatic sections 200 typically comprise an outer wall 202, which is solid (e.g., non-porous) to contain fluids (e.g., gases and liquids) within the adiabatic section 200. Further embodiments comprise a porous medium (e.g., porous wick) to allow liquids to move via capillary action through the adiabatic section. In many such embodiments, the porous medium 204 is disposed on (e.g., adjacent to and/or connected to) the outer wall 202. In many embodiments, the porous medium 204 is manufactured to be monolithic with the outer wall 202, such that they are a single unit, while some embodiments possess a removable or disconnected porous medium 204—for example a porous medium 204 that is manufactured independently of an outer wall 202 and later placed in or inserted into the outer wall 202—in such embodiments, the porous medium 204 can remain separate from the outer wall 202 or affixed to the outer wall 202 via welding, sintering, and/or any other method to generate a unitary heat pipe comprising an outer wall 202 and porous medium 204. Further embodiments allow for gaseous movement via an inner lumen 206 or open space within adiabatic section 200.

In many embodiments, a thickness 208 of the porous medium 204 can be altered to allow various levels of vapor and/or liquid flow through an adiabatic section 200. In some embodiments, the dimensions of the porous medium 204 are such to allow for a two-phase system, such that the adiabatic section 200 allows for simultaneous liquid and gas (e.g., vapor) flow through the adiabatic section 200. In some of these embodiments, the dimensions of the porous medium 204 (e.g., thickness 208) allow for at least 10% vapor flow area, at least 20% vapor flow area, at least 30% vapor flow area, at least 40% vapor flow area, at least 50% vapor flow area, at least 60% vapor flow area, at least 70% vapor flow area, at least 80% vapor flow area, or at least 90% vapor flow area in adiabatic section 200.

Additionally, pore size within the porous medium 204 can be altered to improve capillary action of a liquid. In various embodiments of an adiabatic section 200, the porous medium 204 has variable pore size and/or thickness 208 through its length to alter liquid and/or vapor flow at different positions in a TMS.

Additional embodiments are directed to pipe segments or sections configures solely for a single-phase flow (e.g., liquid only). Such embodiments may lack an inner lumen, wherein the porous medium, fills substantially all of the pipe section, such that substantially all flow through a heat pipe section is in a liquid state or phase. In such embodiments, liquid flow is driven by capillary action within a porous medium.

Figure 3:
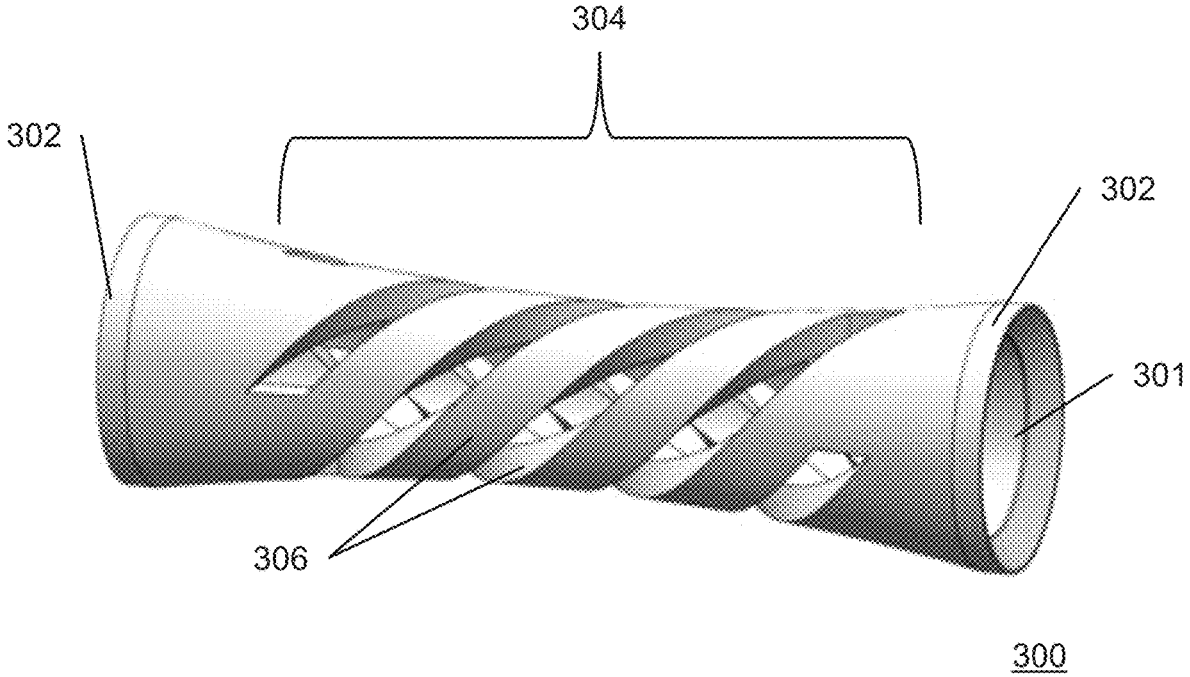
FIG. 3 provides a perspective view of a porous insert in accordance with various embodiments of the invention.

Turning to FIG. 3, an exemplary porous insert 300 in accordance with various embodiments is illustrated. Such embodiments allow for evaporators and/or condensers to be reconnectable, such as after a break or other separation of a heat pipe system. Various embodiments can be utilized with a traditional, fitting, including Swagelok, kwikflange, conflat, solderable, or weldable joints, flared fittings, compression fittings, ferrule fittings, o-ring fittings, barbed fittings, VCR fittings, and/or any other type of pipe fitting. Further embodiments are utilized with permanent fittings, such as brazing, welding, crimping, and/or any other methodology to join pipes (including heat pipes). In various embodiments a fitting (either permanent or replaceable) creates a hermetic or semi-hermetic seal.

As illustrated in FIG. 3, various embodiments of porous insert 300 provide a body defining a longitudinal axis. In many embodiments, the body of the porous insert 300 possesses a capillary structure (e.g., is porous) to allow transport of liquids via capillary action within the body. In further embodiments, the body defines a central bore 301 running longitudinally with the body between ends 302. In such embodiments, the central bore 301 allows gaseous flow (e.g., vapor flow) through the porous insert 300. In numerous embodiments, the ratio of an outer diameter of the central bore 301 to the porous insert 300 to provide a flow area, where the ratio can be adjusted to allow for different amounts of a vapor flow area (or liquid flow area). In some embodiments, the ratio of the flow area is such to allow for a two-phase system, wherein a porous insert provides at least 10% vapor flow area, at least 20% vapor flow area, at least 30% vapor flow area, at least 40% vapor flow area, at least 50% vapor flow area, at least 60% vapor flow area, at least 70% vapor flow area, at least 80% vapor flow area, or at least 90% vapor flow area. Certain embodiments lack a central bore 301 within the porous insert 300, such that substantially all flow through a porous insert 300 is in a liquid state or phase.

In many embodiments porous insert 300 allows for a level of compressibility or compliancy to maintain a force against abutting porous wicks, thus maintaining capillarity between the porous insert 300 and the abutting wick(s), thus allowing connection or joining of heat pipes. In certain embodiments, the structure of a porous insert 300 provides the compressibility due to the compliant nature of the material—for example, the material may allow a level of strain or the capillary structure itself allows for compressibility (e.g., a low density porous wick may allow more compressibility). In many embodiments, the compressible central region allows for a minimum level of longitudinal strain, or relative compression. In certain embodiments the porous insert 300 allow at least 0.1% strain, at least 0.2% strain, at least 0.3% strain, at least 0.4% strain, at least 0.5% strain, at least 0.6% strain, at least 0.7% strain, at least 0.8% strain, at least 0.9% strain, or at least 1.0% strain to allow for pressure of each end against abutting wicks. Depending on size of a porous insert, the porous insert 300 provides an elastic displacement of at least 0.1 mm, at least 0.2 mm, at least 0.3 mm, at least 0.4 mm, at least 0.5 mm, at least 0.6 mm, at least 0.7 mm, at least 0.8 mm, at least 0.9 mm, or at least 1.0 mm to allow for pressure of each end against abutting wicks.

In some embodiment, the compressibility or compliancy is provided by a central region 304. A compressible central region 304 allows a porous insert 300 to maintain a force against abutting porous wicks. To provide compressibility, certain embodiments of the central region 304 possesses one or more flexible structures 306. In some embodiments the flexible structure(s) 306 are coil-like (or spring-like) structures connecting ends 302. Some embodiments possess a single flexible structure 306 between ends 302, while other embodiments possess 2, 3, 4, 5, or more flexible structures 306 between ends 302.

In certain embodiments, central region 304 possesses a narrower outer diameter than ends 302. The narrower central region 304 may prevent the insert from contacting the outer wall, thus preventing mechanical interference within a system.

While FIG. 3 illustrates a linear and generally cylindrical porous insert 300, certain embodiments of porous insert 300 can have different longitudinal shapes, such as an angled shape (e.g., an angle between approximately 1° and 180°, including L-shape (90° angle), U-shape (180° angle)). Some embodiments are configured to join multiple pipes at a single porous insert connector (e.g., a manifold or a header), such as a T-shape, a Y-shape, an X-shape, and/or any other combination of ends and/or angles, to allow for multiple heat pipe segments to be joined at a single connection point. Additional embodiments can include valves or other structures for fluid handling within a porous insert. Further embodiments may possess different cross-sectional shapes, such as circular, oval, D-shaped, square, rectangular, conformal (e.g., a custom geometry which may vary across a surface or be non-uniform throughout the connection) and/or any geometry, including extrusion-type geometries.

Porous inserts 300 in accordance with many embodiments can be constructed via various methods, including additive manufacturing and traditional fabricating. Additive manufacturing methods include stereolithography, fused deposition modeling, selective laser sintering, multi-jet modeling, binder-jet printing, bound metal deposition, directed energy deposition, powder bed fusion, fused filament fabrication, digital light processed, nanoparticle jetting, ultrasonic additive manufacturing, 3D-printing, combinations thereof, and other methods known in the art to be considered additive manufacturing. Traditional fabricating methods include sintering, injection molding, welding, brazing, diffusion bonding, combinations thereof, and/or other methods known in the art to be considered traditional fabricating.

Various embodiments of porous insert 300 are manufactured of a metallic, polymeric, refractory, and/or ceramic material. Examples of such materials include aluminum, titanium, iron nickel, cobalt, copper, magnesium, zinc, zirconium, steel, stainless steel, titanium alloys, nitinol (NiTi), Ti-6Al-4V, and/or any other material providing adequate strength, or capabilities for a specific need or use.

Figure 4B:
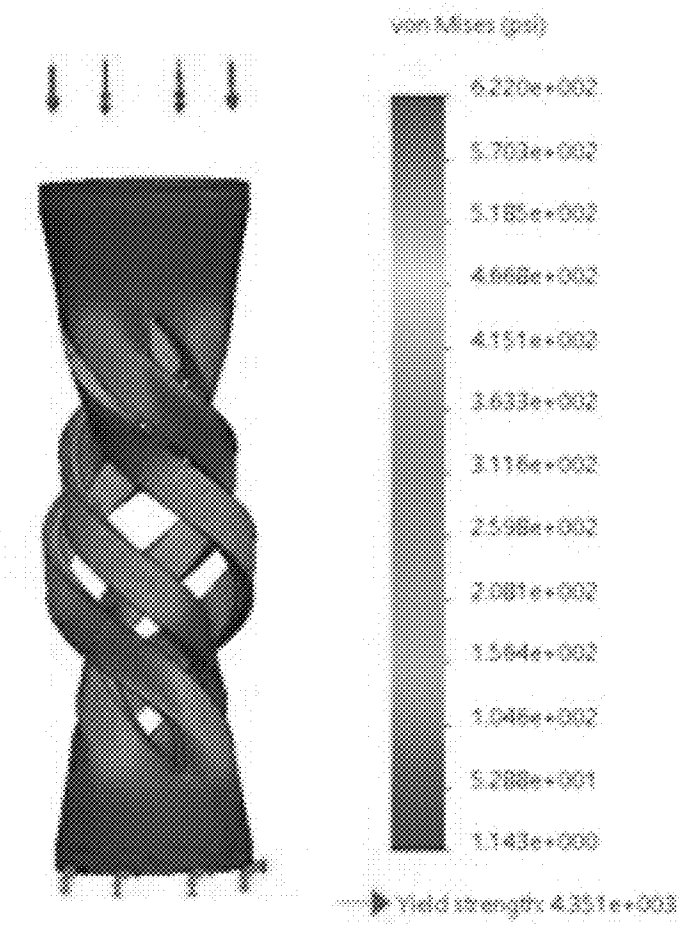
FIGS. 4A-4B illustrate exemplary data of deflection (FIG. 4A) and stresses (FIG. 4B) at a target displacement of an exemplary embodiment.
Figure 4A:
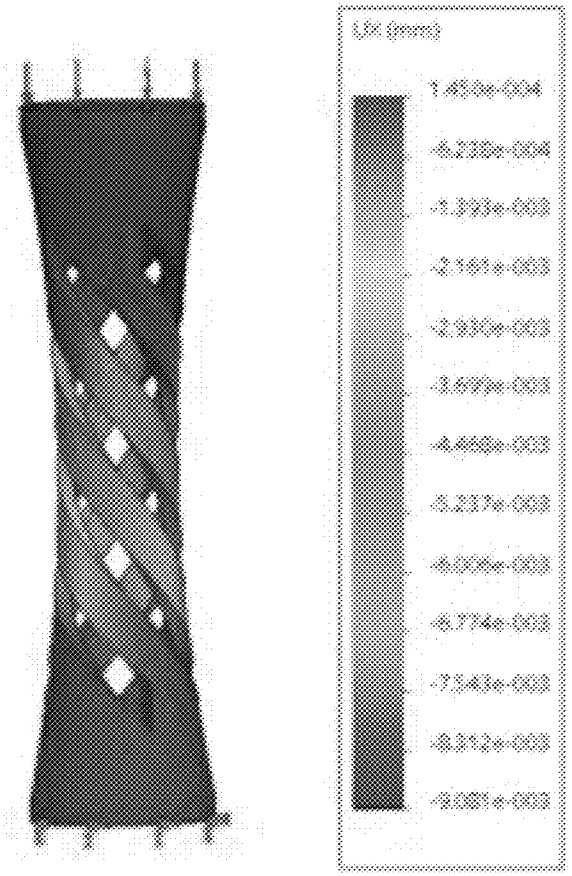

In manufacturing porous inserts 300 in accordance with many embodiments, various design characteristics can be optimized for performance. Manufactured porous inserts 300 of numerous embodiments have a sufficient compliancy to accommodate small dimensional tolerance for the distance between the end of the wick and a corresponding VCR flange and the length of the porous insert 300. In some embodiments, the compression on the contacting interface between a porous wick and a porous insert 300, as well as the internal stresses in the porous insert 300, are lower than the material yield strength with an adequate margin. In further embodiments, the pore size of porous insert 300 is smaller than the abutting porous wicks to prevent a reduction in capillary pressure. Additionally, some embodiments minimally obstruct vapor flow area due to the presence of a porous insert 300 inside of a VCR fitting, which can prevent vapor flow. FIGS. 5A-5B illustrate data of deflection (FIG. 4A) and stresses (FIG. 4B) at a target displacement of an exemplary embodiment. In this exemplary embodiment, porous aluminum was modeled, assuming an elastic modulus of 25 GPa (3625 ksi) (36% of Al-6061) and a yield strength of 5.8 ksi (38.6 MPa). The predicted stiffness is about 1.7 lbf/mm, which is low enough that it would not affect the fitting tightening process (e.g., a VCR fitting).

Figure 5:
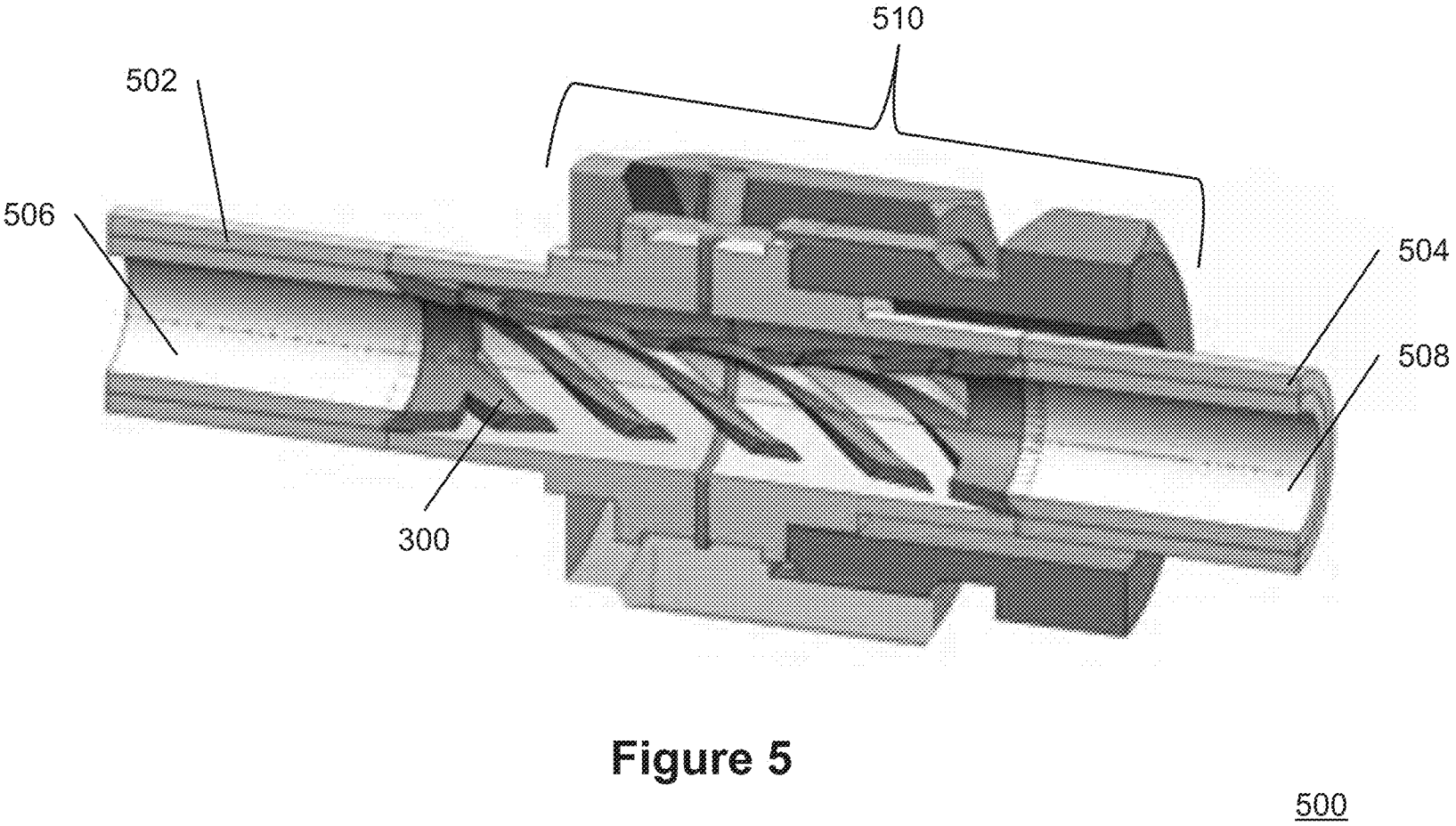
FIG. 5 provides an open view of a connection for joining heat pipes in accordance with various embodiments of the invention.

Turning to FIG. 5, an exemplary connection 500 between heat pipes using an embodiment of a porous insert 300 is illustrated. As illustrated, heat pipe sections 502, 504 each possess a porous wick 506, 508 within the heat pipe. Porous insert 300 is placed such that it abuts the porous wick of two connecting heat pipes. A fitting 510, such as a VCR fitting, Swagelok fitting, and/or any other applicable fitting, can be used to join the pipe sections 502, 504. Compression from fitting 510, provides a loading force between porous wicks 506, 508. In certain embodiments, the fitting allows for a hermetic seal between pipe sections 502, 504. While in other embodiments, the fitting creates a or semi-hermetic seal between pipe sections 502, 504. In accordance with various embodiments, heat pipe sections 502, 504 can be any segment of a thermal management system (TMS), such as a condenser, evaporator, adiabatic section, and/or any other component of a TMS.

In many embodiments, a porous insert 300 possesses a pore size that is similar to or smaller than the joining porous wicks 506, 508 so that overall capillary head of the connected wick is similar to that of one-piece wick. However, certain embodiments provide variable pore size within a porous insert 300, such that heat pipes with different pore sizes can be joined. Porous inserts 300 in accordance with some embodiments possess variable permeabilities throughout the length, which can be optimized for specific fluids (e.g., coolants) within a heat pipe or system.

EXEMPLARY EMBODIMENTS

Experiments were conducted to demonstrate the capabilities of the evaporators and thermal control system in accordance with embodiments. These results and discussion are not meant to be limiting, but merely to provide examples of operative devices and their features.

Example 1: Porous Inserts

METHODS: Manufacture: Porous inserts were manufactured via 3D printing to include various aluminum inserts with different pore sizes. An embodiment constructed of a porous titanium alloy (Ti-6Al-4V), since titanium alloy is a common wick material.

Figure 6:
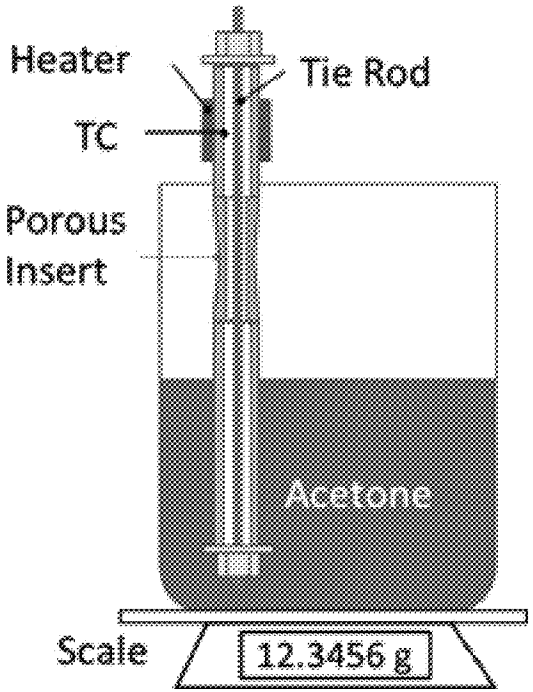
FIG. 6 provides a test setup used to test porous inserts in accordance with various embodiments of the invention.

Permeability Testing: To compare the performance of a connected wick with a continuous, single-piece wick, a test setup shown in FIG. 6 was assembled and instrumented. This test setup measures the permeability of the wick by determining the maximum evaporative cooling capacity for a heater attached to the wick and the corresponding capillary flow rate. As a baseline case, the temperature of a dried connected wick with a porous insert between the upper and lower segments was first characterized with a very low heater power input. The result of this case allows assessment of the sensible cooling power provided by the ambient air natural convection.

Next, the lower end of the connected wick was submerged in acetone to draw liquid into the lower section and transfer it against the gravity to the upper section where a thin-film Kapton heater was attached. As the heater power incrementally increased, the temperatures near the heater gradually increased to the normal boiling temperature of acetone. As the heater power further increased, the heater temperatures would remain unchanged until the heater power reached a point where liquid flow inside the wick evaporated completely before reaching the heater. When the wick area under the heater was dried out, its temperature would then rise above acetone's normal boiling point.

After completing the testing for a connected wick, the performance of a continuous, one-piece wick was characterized and its performance compared with the connected wick. During these two tests, the heater was maintained at approximately the same elevation relative to the acetone liquid level to impose the same adverse gravity head in the capillary flows. As a redundant measurement, the evaporation rate of acetone from the beaker was also measured with a mass balance. The evaporation rate measurement is a more direct way to measure the liquid flow rate into the wick.

Bubble Point Testing: An existing bubble point test apparatus was adapted to characterize the effective pore size at the interface between a wick and our porous insert sample. A porous plate sample was clamped on a flange with a ⅛ inches nitrogen gas supply port having a sealing O-ring at the interface. The test apparatus was submerged in ethanol. The bubble point was measured by applying gas pressure until gas freely flowed through the coupon and then shutting off the gas. Once the gas stopped emerging from the coupon the pressure across the wick was measured. This is considered to be a descending pressure bubble point measurement. The average bubble point is 68.7±1.5 mm of isopropanol column based on 10 measurements, corresponding to an effective pore size of 84 microns. To measure the bubble point of the interface between two porous plates, two porous plates were stacked together. The lower one facing the gas port has a circular cutout to allow the gas to have direct access to the interface. The average bubble point is 63.3±5.8 mm of isopropanol column for the interface based on 10 measurements, corresponding to an effective pore size of 91 microns. This pore size is close the 84-micron pore size of the parent wick material.

Figure 7:
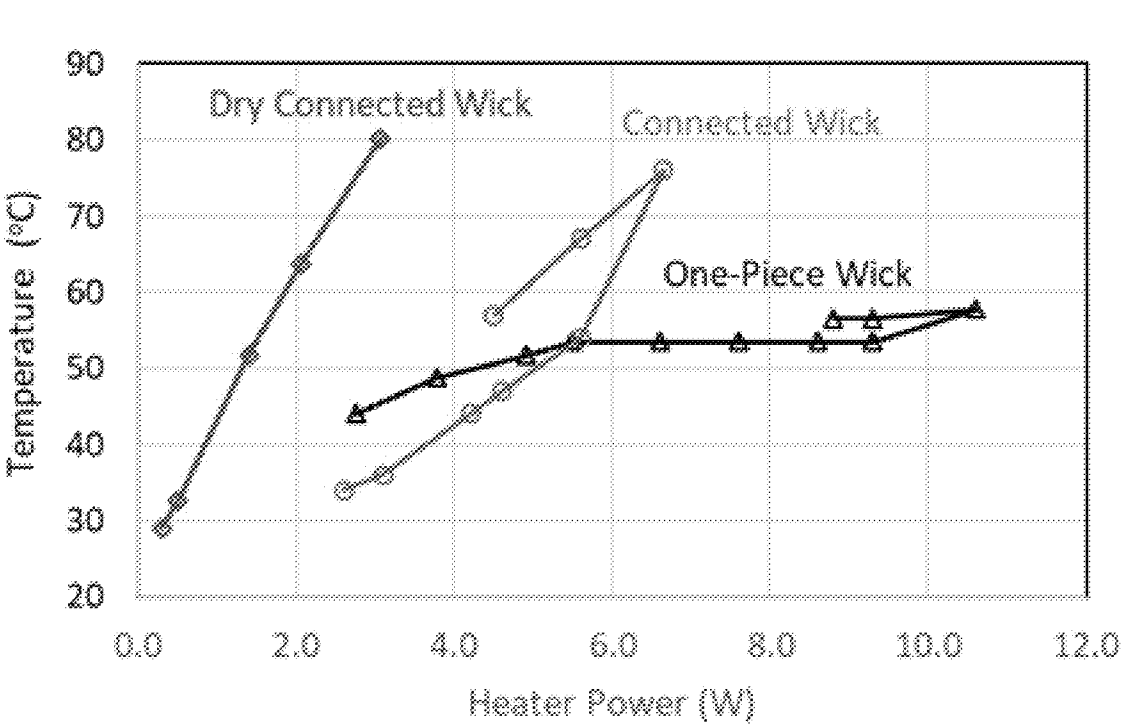
FIG. 7 illustrates exemplary data showing temperatures of a dry connected wick, a wetted connected wick, and a one-piece wick at different power levels in accordance with various embodiments of the invention.

RESULTS: FIG. 7 compares the temperatures of the dry connected wick, wetted connected wick and the one-piece wick at different power levels. As expected, the dry wick reached temperatures significantly higher than the wetted wicks at the same power levels. At low power, the wetted connected wick outperformed the wetted one-piece wick. This might be because the larger exposed surface area due to the features in the porous insert, which enhanced the mass transfer with ambient air and thus the evaporative cooling. When the power reached about 5.6 W, the connected wick temperature exceeded that of the one-piece wick, which was able to maintain the heater at the normal boiling temperature until the input power exceeded 9.3 W. The evaporation rate in the connected wick is 0.35 g/m in at 5.6 W, comparing to the maximum evaporation rate of 0.80 g/min at 9.3 W in the one-piece wick. The evaporation rate is consistent with heater power input, after deducting the convective cooling by the ambient air.

Note that unlike the one-piece wick, the connected wick was not able to hold the heater at the normal boiling temperature over an input power range; the heater temperature continued to rise with input power. This might be because the flow inside the wick completely evaporated before it reached the heater, and the heater replied on thermal conduction to the wetted area below it to dissipate heat.

CONCLUSIONS: The preliminary design and testing results show the feasible of the separable heat pipe technology. An insert design was developed with features to enhance the bubble point and reduce the flow resistance at the capillary interfaces between the insert and its adjacent wicks. Fabrication of the porous insert by an additive manufacturing approach was successfully demonstrated. The insert has sufficient compliant and structural strength for the target application. Separate-effect bubble point testing shows that the effective bubble point of the interface between the insert and its adjacent wick is very close to that of the parent wick materials. Evaporative cooling testing shows that the flow rate in a connected wick is about 45% of a continuous wick. This is consistent with design expectations, considering the reduced flow cross section area and longer flow path in this initial insert design.

The performance testing shows the feasibility of a SHP with a layout shown in FIG. 1, consisting of a network of individual components with their capillary structure interconnected. The next step is to optimize the insert design for a target application, assemble a SHP with at least two parallel evaporators, charge a hermetic SHP with a working fluid and demonstrate its thermal performance.

DOCTRINE OF EQUIVALENTS

While the above description contains many specific embodiments of the invention, these should not be construed as limitations on the scope of the invention, but rather as an example of one embodiment thereof. Accordingly, the scope of the invention should be determined not by the embodiments illustrated, but by the appended claims and their equivalents.

What is claimed is:

1. A thermal management system, comprising:

an evaporator, a condenser, and an adiabatic section in fluid communication, wherein the evaporator is connected to the condenser via the adiabatic section, wherein the adiabatic section comprises an outer wall and a porous medium disposed on the outer wall; and wherein at least one of the evaporator and the condenser is joined to the adiabatic section via a connection, the connection comprising a porous insert, the porous insert comprising a body defining a longitudinal axis and defining a central bore running longitudinally with the body between opposing ends of the body, the body being compressible and comprising a capillary structure to allow for liquid transport.

2. The thermal management system of claim 1, wherein the body further comprises a central region to provide compressibility, wherein the central region provides an elastic displacement of at least 0.2 mm.

3. The thermal management system of claim 1, wherein the body provides at least 0.2% longitudinal strain.

4. The thermal management system of claim 1, wherein the connection uses a fitting to hermetically or semi-hermetically seal the connection.

5. The thermal management system of claim 4, wherein the fitting is selected from a Swagelok fitting, a kwikflange fitting, a conflat fitting, a solderable fitting, a weldable joint, a flared fitting, a compression fitting, a ferrule fitting, an o-ring fitting, a barbed fitting, and a VCR fitting.

6. The thermal management system of claim 1, wherein the adiabatic section is configured for two phases, wherein the porous medium allows for simultaneous liquid flow and vapor flow through the adiabatic section.

7. The thermal management system of claim 6, wherein at least one of the evaporator, the condenser, and the adiabatic section comprises a different porosity within the porous medium or a dimension of the porous medium to alter liquid flow or vapor flow.

8. The thermal management system of claim 6, wherein a thickness of the porous medium allows for at least 10% of a cross sectional area of the adiabatic section for vapor flow.

9. The thermal management system of claim 1, wherein the evaporator is a plurality of evaporators or the condenser is a plurality of condensers.

10. The thermal management system of claim 9, wherein the plurality of evaporators are connected in parallel, in series, or in a hybrid parallel-series arrangement or the plurality of condensers are connected in parallel, in series, or in a hybrid parallel-series arrangement.

11. The thermal management system of claim 1, wherein the evaporator is embedded within a heat-generating component or the condenser is embedded within a heat-rejecting component.

12. The thermal management system of claim 11, wherein the heat-generating component or the heat-rejecting component is 3D printed.

* * * * *